US008852365B2

(12) United States Patent
Sankaran et al.

(10) Patent No.: US 8,852,365 B2
(45) Date of Patent: Oct. 7, 2014

(54) WELDABLE HIGH-STRENGTH ALUMINUM ALLOYS

(75) Inventors: Krishnan K. Sankaran, St. Louis, MO (US); Kevin T. Slattery, St. Charles, MO (US)

(73) Assignee: The Boeing Company, Chicago, IL (US)

( * ) Notice: Subject to any disclaimer, the term of this patent is extended or adjusted under 35 U.S.C. 154(b) by 1345 days.

(21) Appl. No.: 12/349,668

(22) Filed: Jan. 7, 2009

(65) Prior Publication Data

US 2010/0170996 A1 Jul. 8, 2010

(51) Int. Cl.
*C22F 1/047* (2006.01)

(52) U.S. Cl.
USPC ..... 148/551; 148/694; 148/698; 228/112.1

(58) Field of Classification Search
USPC ..... 148/549–552, 688–704; 228/112.1, 228/113, 114, 114.5; 428/654
See application file for complete search history.

(56) References Cited

U.S. PATENT DOCUMENTS

| | | | | |
|---|---|---|---|---|
| 3,619,181 | A | 11/1971 | Willey | |
| 5,238,646 | A | 8/1993 | Tarcy et al. | |
| 5,597,529 | A | 1/1997 | Tack | |
| 5,620,652 | A | 4/1997 | Tack et al. | |
| 5,624,632 | A * | 4/1997 | Baumann et al. | 420/544 |
| 6,258,318 | B1 | 7/2001 | Lenczowski et al. | |
| 6,280,543 | B1 * | 8/2001 | Zonker et al. | 148/551 |
| 6,524,410 | B1 * | 2/2003 | Kramer et al. | 148/550 |
| 6,779,708 | B2 | 8/2004 | Slattery | |
| 6,910,616 | B2 | 6/2005 | Halley et al. | |
| 7,083,076 | B2 | 8/2006 | Slattery | |
| 7,128,948 | B2 | 10/2006 | Slattery | |
| 7,156,276 | B2 | 1/2007 | Slattery | |
| 7,225,967 | B2 | 6/2007 | Slattery | |
| 7,347,351 | B2 | 3/2008 | Slattery | |
| 7,353,978 | B2 | 4/2008 | Slattery et al. | |
| 7,381,446 | B2 | 6/2008 | Slattery | |
| 2006/0054252 | A1 * | 3/2006 | Sankaran et al. | 148/535 |

FOREIGN PATENT DOCUMENTS

| | | | |
|---|---|---|---|
| DE | 10248594 | A1 | 7/2003 |
| EP | 1217085 | A1 | 6/2002 |
| RU | 2184165 | C2 | 6/2002 |
| RU | 2237097 | C1 | 9/2004 |
| WO | 2007020041 | A2 | 2/2007 |

OTHER PUBLICATIONS

Palm, "Scalmalloy, A unique high strength and corrosion insensitive AlMgScZr material concept," EADS Innovation Works, Sep. 2008, pp. 1-25.

Herding et al., "Spray formed and rolled aluminum-magnesium-scandium alloys with high scandium content," Materialwissenschaft and Werkstofftechnik, vol. 38, Issue 10, Oct. 2007, pp. 855-861.

(Continued)

*Primary Examiner* — Roy King
*Assistant Examiner* — Janelle Morillo
(74) *Attorney, Agent, or Firm* — Yee & Associates, P.C.

(57) ABSTRACT

An aluminum alloy comprises aluminum, magnesium, scandium, and an enhancing system. The magnesium is from about 0.5 percent to about 10.0 percent by weight based on the aluminum alloy. The scandium is from about 0.05 percent to about 10.0 percent by weight based on the aluminum alloy. The enhancing system is from about 0.05 percent to about 1.5 percent by weight based on the aluminum alloy.

17 Claims, 2 Drawing Sheets

(56) References Cited

OTHER PUBLICATIONS

Royset et al., "Scadium in aluminum alloys," International Materials Reviews, vol. 50, No. 1, Feb. 2005, pp. 19-44.
Sawtell et al., "Mechanical Properties and Microstructures of Al—Mg—Sc Alloys", Metallurgical Transactions, vol. 21A, Feb. 1990, pp. 421-430.
Domack et al., "Evaluation of Sc-Bearing Aluminum Alloy C557 for Aerospace Applications", NASA/TM-2002-211633, Apr. 2002, Virginia, pp. 1-10.
Lee et al., "Aluminum—Scandium Alloys: Material Characterization, Friction Stir Welding, and Compatibility With Hydrogen Peroxide" (MSFC Center Director's Discretionary Fund Final Report Project, No. 04-13) Alabama, Dec. 2004, pp. 1-20.
Parker et al., "The effect of small additions of scandium on the properties of aluminium alloys", Department of Materials Engineering, Monash University, Clayton, Australia, 1995, Chapman & Hall, pp. 452-458.
Munoz et al., "Comparison of TIG welded and friction stir welded A1-4.5Mg-026Sc alloy", Journal of Materials Processing Technology I97 (2008), pp. 337-343.

* cited by examiner

WELDABLE HIGH-STRENGTH ALUMINUM ALLOYS

BACKGROUND INFORMATION

1. Field

The present disclosure relates generally to metals and, in particular, to aluminum alloys. Still more particularly, the present disclosure relates to a method and apparatus for aluminum alloys used in aircraft parts.

2. Background

Aluminum is an abundant material that has an ability to resist corrosion and a low density. Aluminum and its alloys are often used for various components. For example, aluminum and aluminum alloys may be used as structural components in manufacturing vehicles such as, for example, automobiles, aircraft, ships, and/or other vehicles.

Although aluminum alloys have many desirable properties, aluminum alloys with the desired strength for use in aircraft are not readily weldable. Welding of aluminum alloys may cause degradation in the properties, such as strength.

Currently, manufacturing parts from aluminum alloys is performed from larger pieces, either solid blocks, plates, or closed die forgings, that are machined. This type of process provides increased weight savings and an easy fit for assembly. With this type of process, fasteners and built-up structures are unnecessary. However, large amounts of material may be wasted by machining from solid blocks and plates, while forgings require expensive tools and can result in distorting residual stresses in the parts. Additionally, lead times and differences in material demands may generate limits for this type of manufacturing of aerospace parts.

Therefore, it would be advantageous to have a method and apparatus that takes into account one or more of the issues discussed above, as well as possibly other issues.

SUMMARY

In one advantageous embodiment, an aluminum alloy comprises aluminum, magnesium, scandium, and an enhancing system. The magnesium is from about 0.5 percent to about 10.0 percent by weight based on the aluminum alloy. The scandium is from about 0.05 percent to about 10.0 percent by weight based on the aluminum alloy. The enhancing system is from about 0.05 percent to about 1.5 percent by weight based on the aluminum alloy.

In another advantageous embodiment, an aluminum alloy comprises aluminum, magnesium, scandium, and an enhancing system. The magnesium is from about 0.5 percent to about 10.0 percent by weight based on the aluminum alloy. The scandium is from about 0.05 percent to about 10.0 percent by weight based on the aluminum alloy.

In yet another advantageous embodiment, an aircraft part comprises a plurality of plates welded to each other to form the aircraft part. The plurality of plates each comprises aluminum, magnesium, scandium, and zirconium. The magnesium is from about 0.5 percent to about 10.0 percent by weight based on the aluminum alloy. The scandium is from about 0.05 percent to about 10.0 percent by weight based on the aluminum alloy. The enhancing system is from about 0.05 percent to about 1.5 percent by weight based on the aluminum alloy.

In still yet another advantageous embodiment, a method is present for processing an aluminum alloy. The aluminum alloy is formed into a form of a molten alloy. The aluminum alloy comprises aluminum, magnesium, scandium, and an enhancing system. The molten alloy is cast into a plurality of sections using a continuous casting process. A plurality of blanks is formed from the plurality of sections.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives and advantages thereof, will best be understood by reference to the following detailed description of an advantageous embodiment of the present disclosure when read in conjunction with the accompanying drawings, wherein:

DETAILED DESCRIPTION

Figure 1:
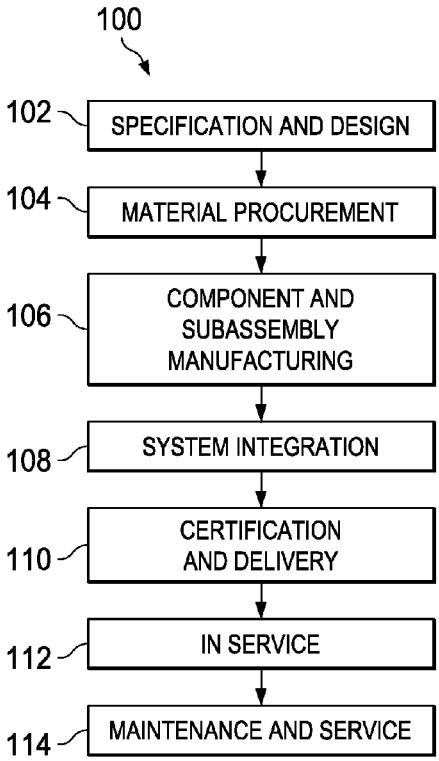
FIG. 1 is a diagram illustrating an aircraft manufacturing and service method in accordance with an advantageous embodiment.
Figure 2:
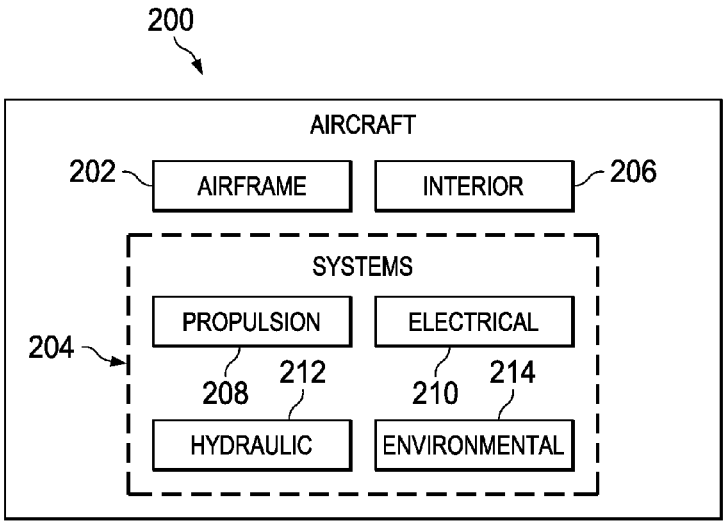
FIG. 2 is a diagram of an aircraft in which an advantageous embodiment may be implemented.

Referring more particularly to the drawings, embodiments of the disclosure may be described in the context of aircraft manufacturing and service method 100 as shown in FIG. 1 and aircraft 200 as shown in FIG. 2. Turning first to FIG. 1, a diagram illustrating an aircraft manufacturing and service method is depicted in accordance with an advantageous embodiment. During pre-production, exemplary aircraft manufacturing and service method 100 may include specification and design 102 of aircraft 200 in FIG. 2 and material procurement 104.

During production, component and subassembly manufacturing 106 and system integration 108 of aircraft 200 in FIG. 2 takes place. Thereafter, aircraft 200 in FIG. 2 may go through certification and delivery 110 in order to be placed in service 112. While in service by a customer, aircraft 200 in FIG. 2 is scheduled for routine maintenance and service 114, which may include modification, reconfiguration, refurbishment, and other maintenance or service.

Each of the processes of aircraft manufacturing and service method 100 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of venders, subcontractors, and suppliers; and an operator may be an airline, leasing company, military entity, service organization, and so on.

With reference now to FIG. 2, a diagram of an aircraft is depicted in which an advantageous embodiment may be implemented. In this example, aircraft 200 is produced by aircraft manufacturing and service method 100 in FIG. 1 and may include airframe 202 with a plurality of systems 204 and interior 206. Examples of systems 204 include one or more of propulsion system 208, electrical system 210, hydraulic system 212, and environmental system 214. Any number of other systems may be included. Although an aerospace example is shown, different advantageous embodiments may be applied to other industries, such as the automotive industry.

Apparatus and methods embodied herein may be employed during any one or more of the stages of aircraft manufacturing and service method 100 in FIG. 1. For example, components or subassemblies produced in component and subassembly manufacturing 106 in FIG. 1 may be fabricated or manufactured in a manner similar to components or subassemblies produced while aircraft 200 is in service 112 in FIG. 1.

Also, one or more apparatus embodiments, method embodiments, or a combination thereof may be utilized during production stages, such as component and subassembly manufacturing 106 and system integration 108 in FIG. 1, for example, without limitation, by substantially expediting the assembly of or reducing the cost of aircraft 200. Similarly, one or more of apparatus embodiments, method embodiments, or a combination thereof may be utilized while aircraft 200 is in service 112 or during maintenance and service 114 in FIG. 1.

For example, one or more advantageous embodiments may be used during component and subassembly manufacturing to manufacture and/or fabricate parts for aircraft 200. As another example, different advantageous embodiments may be used during maintenance and service 114 to manufacture aircraft parts for use in maintenance, repair, and/or refurbishing aircraft 200.

The different advantageous embodiments recognize and take into account that it would be desirable to have a capability to weld sections of aluminum alloys together to manufacture aircraft parts rather than creating parts using machining processes. The different advantageous embodiments recognize and take into account that aluminum alloys with magnesium are currently used in creating parts for vehicles, such as automobiles and ships. These types of alloys are not currently used for aerospace purposes, because they do not have the needed strength.

Thus, one or more of the different advantageous embodiments provide a new family of aluminum alloys with strength and corrosion properties that are not substantially degraded by fusion and/or solid state welding processes. Further, this family of alloys may provide strength properties comparable to currently used aluminum alloys that are not weldable.

The different advantageous embodiments recognize and take into account that scandium by itself, or in combination with transition elements, such as zirconium, has been used as an alloying element for aluminum to improve properties of non-heat treatable aluminum alloys with magnesium. The different advantageous embodiments recognize and take into account that current literature limits the amount of scandium in alloys with aluminum and magnesium. Current convention is that adding higher levels of scandium may result in the formation of scandium-containing particles during alloy solidification. These particles may result in reduced alloy strength and ductility.

The different advantageous embodiments recognize and take into account that the current convention is to limit the scandium level to around 0.5 percent by weight based on the alloy. As a result, the different advantageous embodiments recognize and take into account that these types of alloys have not been used in aerospace applications.

Although these types of limitations have been previously recognized, the different advantageous embodiments have identified an aluminum alloy in which scandium may be added in amounts up to around one percent by weight based on the metal alloy. Scandium, in combination with other elements that have less than around 1.0 weight percent by weight solubility in aluminum at all temperatures up to that at which the alloy begins to melt, but have solubility in liquid aluminum and/or selected processes, may provide an aluminum alloy that may be weldable as well as have strength property requirements. One exception is silver. Silver has a maximum solid solubility in excess of around 50 percent by weight.

The aluminum alloys in the different advantageous embodiments may provide increased strength, while maintaining corrosion resistance and weldability.

The different advantageous embodiments provide an aluminum alloy comprising aluminum, magnesium from about 0.5 percent to about 10.0 percent by weight based on the aluminum alloy, scandium from about 0.05 percent to about 10.0 percent by weight based on the aluminum alloy, and zirconium from about 0.05 percent to about 1.5 percent by weight based on the aluminum alloy.

Figure 3:
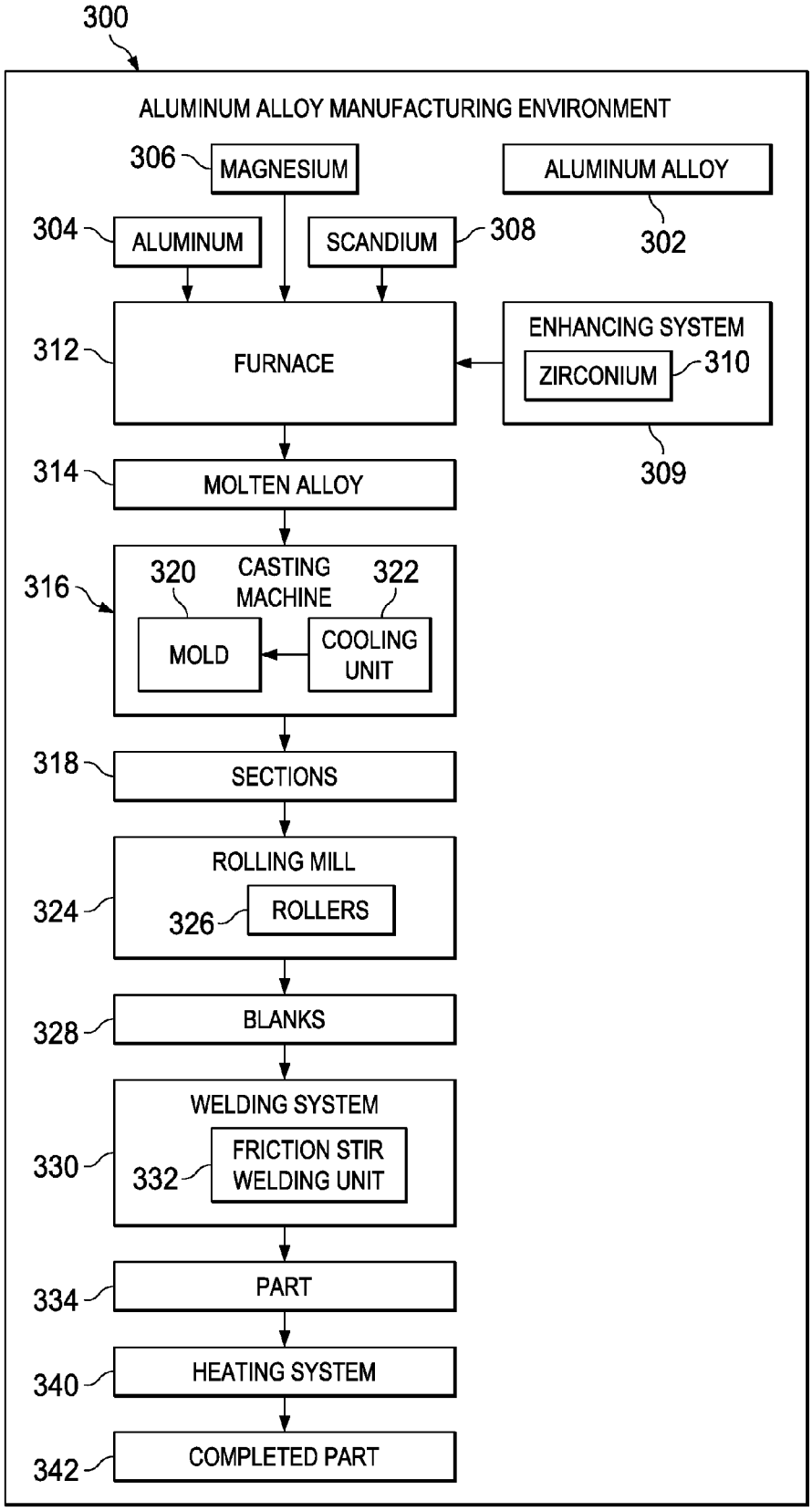
FIG. 3 is a diagram illustrating an aluminum alloy manufacturing environment in accordance with an advantageous embodiment.

With reference now to FIG. 3, a diagram illustrating an aluminum alloy manufacturing environment is depicted in accordance with an advantageous embodiment. Aluminum alloy manufacturing environment 300 may be used during aircraft manufacturing and service method 100 to manufacture parts for aircraft 200.

In this illustrative example, aluminum alloy manufacturing environment 300 may use aluminum alloy 302 comprising aluminum (Al) 304, magnesium (Mg) 306, scandium (Sc) 308, and enhancing system 309. Enhancing system 309, in these examples, takes the form of zirconium (Zr) 310. Enhancing system 309 may be a number of elements having very limited and/or no solubility in aluminum at room temperature but having solubility in liquid aluminum. A number, as used herein, refers to one or more items. For example, a number of elements is one or more elements.

Enhancing system 309 may be a number of elements that may precipitate as inter-metallic compounds independently and/or in combination with scandium. The precipitation of inter-metallic compounds may increase the strength of aluminum alloy 302. An example of an element that may be precipitated as an inter-metallic compound is zirconium.

In the different advantageous embodiments, enhancing system 309 may be comprised of at least one of period 4 transition elements, period 5 transition elements, period 6 transition elements, period 7 transition elements, lanthanides, group 2 elements, a metallic element from group 13, a metallic element from group 14, a metallic element from group 15, a semi-metallic element from group 13, a semi-metallic element from group 14, and/or a semi-metallic element from group 15. The use of the terms "group" and "period" refer to the use of these terms with reference to a periodic table of elements. A group is a vertical column of elements in the table, and a period is a horizontal row in the table.

As used herein, the phrase "at least one of", when used with a list of items, means that different combinations of one or more of the items may be used and only one of each item in the list may be needed. For example, "at least one of item A, item B, and item C" may include, for example, without limitation, item A, or item A and item B. This example also may include item A, item B, and item C, or item B and item C.

In these examples, period 4 transition elements include titanium (Ti), vanadium (V), chromium (Cr), manganese (Mn), iron (Fe), cobalt (Co), and nickel (Ni). Period 5 transition elements include yttrium (Y), zirconium (Zr), niobium (Nb), molybdenum (Mo), technetium (Tc), ruthenium (Ru), rhodium (Rh), palladium (Pd), silver (Ag), and cadmium (Cd). Period 6 transition elements include hafnium (Hf), tantalum (Ta), tungsten (W), rhenium (Re), osmium (Os), iridium (Ir), platinum (Pt), and gold (Au). A period 7 transition element includes thorium (Th).

Lanthanides include lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu). Group 2 elements include beryllium, calcium, strontium, and barium. Group 13, 14, and 15 elements include boron, germanium, indium, tin, lead, and bismuth.

Aluminum alloy 302 may be generated by mixing these components in furnace 312 to form molten alloy 314. Furnace 312 may be implemented using any furnace suitable for melting aluminum alloys. For example, an IFJ 181820 Burn Out Furnace from Pyradia may be used.

Molten alloy 314 is a molten form of aluminum alloy 302. In these illustrative examples, magnesium 306 may be present from about 0.5 percent to about 10.0 percent by weight based on aluminum alloy 302. In other words, the weight of magnesium 306 is a percentage of the weight of aluminum alloy 302. For example, if aluminum alloy 302 weighs 100 pounds, magnesium 306 is present from about 0.5 pounds to about 10.0 pounds.

Aluminum alloy 302 also has scandium present from about 0.05 percent to about 10.0 percent by weight based on aluminum alloy 302. Zirconium is present in aluminum alloy 302 from about 0.05 percent to about 1.5 percent by weight based on aluminum alloy 302.

Aluminum alloy 302 may be prepared, in one illustrative example, by mixing the alloying elements in the desired proportion in any solid form either in elemental form or as commonly used master alloys. One method may be to combine aluminum, magnesium, an aluminum-scandium master alloy containing 2 percent by weight scandium, and an aluminum-zirconium master alloy containing 10 percent by weight zirconium in the desired proportion.

The alloy is melted and typically held at a temperature of about 750 degrees Celsius. This temperature is about 100 degrees Celsius above the melting temperature. The alloy can be melted in air. Grain refiners, such as aluminum titanium boron (Al—TiB) master alloy, can be used in the melt, and argon can be injected into the melt for degassing. These processes for mixing alloys are ones that are currently used and are well known.

Once molten alloy 314 is formed from aluminum 304, magnesium 306, scandium 308, and zirconium 310, casting machine 316 processes molten alloy 314 into sections 318. Casting machine 316 may be implemented using any available device suitable for continuous casting of alloys. For example, casting machine 316 may be a horizontal single belt caster.

Sections 318 may take various forms depending on the type of continuous casting machine and process used. Sections 318 may have various sizes and shapes. For example, these sections may be shapes, such as strips, beams, circles, and/or some other suitable shape.

Casting machine 316 may create sections 318 in the form of a billet, a bloom, a slab, a strip, a near-net shaped beam, or some other suitable shape. In these illustrative examples, casting machine 316 may receive molten alloy 314 and transfer molten alloy 314 to mold 320 to create sections 318. For example, molten alloy 314 is cast directly and continuously onto mold 320. Molten alloy 314 solidifies against mold 320 and is continuously withdrawn from mold 320.

The use of continuous casting with casting machine 316 provides increased metal solidification rates as compared to conventional casting processes. This type of process may allow the use of alloying element additions beyond what is normally practical. An illustrative example of additions is using more than 0.5 percent by weight scandium and other enhancing elements.

Blanks 328 may be formed from sections 318. This forming process may be performed to impart a shape, dimensions, and/or desired mechanical properties to aluminum alloy 302. This forming process may occur by deforming sections 318. In these examples, sections 318 may be processed by rolling mill 324. Rolling mill 324 is used to implement a metal working process to deform sections 318. This deformation is performed by passing sections 318 through rollers 326 in rolling mill 324, while sections 318 are at a temperature below the re-crystallization temperature for sections 318.

A re-crystallization temperature is a temperature in which nucleation and growth of new undeformed grains occur in a deformed metal. The temperature also may be selected as below around 300 degrees Celsius.

Up to about 90 percent reduction of section size for sections 318 may be imparted by rolling to achieve the desired final section dimensions. Sections 318 may also be processed by other standard metalworking processes, such as forging or extrusion. These other processes also may create a shape, dimensions, and/or mechanical properties that may be desired for blanks 328.

Blanks 328 may be joined using welding system 330. Welding system 330 generates heat needed to join blanks 328 to each other. This joining may be performed by heating the blanks at the surfaces at which the blanks are to be joined to each other.

In these illustrative examples, welding system 330 may take the form of friction stir welding unit 332. Friction stir welding unit 332 may rotate a probe at a joint line between two blanks in blanks 328. This rotation of the probe may generate heat to cause aluminum alloy 302 in blanks 328 to soften without reaching the melting point. Force may be applied to the two blanks, and re-crystallization may result in the two blanks being welded to each other. Friction stir welding unit 332 may be implemented using any available friction stir welding device. For example, a friction stir welding system from General Tool Company may be used.

Friction stir welding unit 332 may generate heat through mechanical friction. With this type of welding, no melting occurs. Instead, this type of welding is closer to a forging type process. Friction stir welding unit 332 may be used to reduce the amount of heat-affected zones or areas. By avoiding melting of aluminum alloy 302 in blanks 328, grain growth also may be avoided.

By joining blanks 328, part 334 is formed. Part 334 may be, for example, a skin panel, a spar, a rib, a bulkhead, a keel, a longeron, a stringer, a gusset, a floor beam, a hinge, a stiffener, a flap track, a pin, a doubler, a splice plate, a trunnion, a slat track, a frame, a fairing, and/or some other suitable type of part.

Heating system 340 processes part 334 to generate completed part 342. Heating system 340 performs thermal aging on part 334. This thermal aging process may be used to increase the strength in part 334 after welding by welding system 330.

In these illustrative examples, heating system 340 may heat part 334 at a temperature from around 100 degrees Celsius to around 400 degrees Celsius. The time at which heat may be applied by heating system 340 may be from around a few minutes to around a few hundred hours. In these illustrative examples, part 334 may be heated at a temperature from around 250 degrees Celsius to around 350 degrees Celsius for a length of time from around one to around 20 hours.

The illustration of aluminum alloy manufacturing environment 300 in FIG. 3 is not meant to imply physical or architectural limitations to the manner in which different advantageous embodiments may be implemented. For example, other components may be used in addition to, or in place of, the ones illustrated in some advantageous embodiments. In other advantageous embodiments, some components may be unnecessary. For example, in some advantageous embodiments, additional metals or other materials may be present in aluminum alloy 302 in addition to aluminum 304, magnesium 306, scandium 308, and zirconium 310.

In some advantageous embodiments, other types of welding mechanisms may be used other than that provided by friction stir welding unit 332. For example, friction welding, linear friction welding, laser welding, and/or other suitable welding processes may be used. As another example, in other advantageous embodiments, some machining may be performed on part 334 or completed part 342 prior to use.

Figure 4:
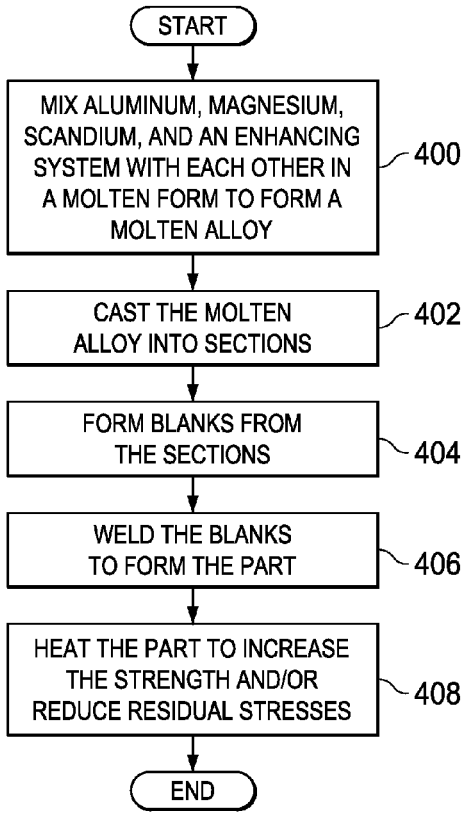
FIG. 4 is a flowchart of a process for processing an aluminum alloy in accordance with an advantageous embodiment.

With reference now to FIG. 4, a flowchart of a process for processing an aluminum alloy is depicted in accordance with an advantageous embodiment. The process illustrated in FIG. 4 may be implemented in an environment such as, for example, aluminum alloy manufacturing environment 300 in FIG. 3.

The process begins by mixing aluminum, magnesium, scandium, and an enhancing system with each other in a molten form to form a molten alloy (operation 400). In these examples, magnesium may be present from around 0.5 percent to around 10.0 percent by weight based on the aluminum alloy. Scandium may be present from about 0.05 percent to about 10.0 percent by weight based on the aluminum alloy. The enhancing system may be present from about 0.05 percent to about 1.5 percent by weight based on the aluminum alloy.

The enhancing system may be at least one of titanium, vanadium, chromium, manganese, iron, cobalt, nickel, yttrium, zirconium, niobium, molybdenum, technetium, ruthenium, rhodium, palladium, silver, cadmium, hafnium, tantalum, tungsten, rhenium, osmium, iridium, platinum, gold, silver, lanthanum, cerium, praseodymium, neodymium, promethium, samarium, europium, gadolinium, terbium, dysprosium, holmium, erbium, thulium, ytterbium, lutetium, beryllium, calcium, strontium, barium, boron, germanium, indium, tin, lead, bismuth, and thorium from about 0.05 percent to about 1.5 percent by weight based on the aluminum alloy. In this illustrative example, the enhancing system used is zirconium, which may be present from about 0.05 percent to about 1.5 percent by weight based on the aluminum alloy.

The molten alloy is then cast into sections (operation 402). These sections may be, for example, strips. Further, the casting may be performed using a continuous casting process. The process then forms blanks from the plurality of sections (operation 404). Operation 404 may be performed to process the plurality of sections such that these sections have the desired shape, dimensions, and/or mechanical properties. Operation 404 may form blanks from the plurality of sections by deforming the plurality of sections. This deformation may provide the shape, dimensions, and/or mechanical properties that may not be present in the plurality of blanks after casting.

In the different advantageous embodiments, the plurality of blanks is typically not used after casting. Operation 404 provides a process to transform these sections into blanks that may have the desired shape, dimensions, and/or mechanical properties. The forming step in operation 404 may be implemented using a number of different processes. For example, without limitation, the forming step may be performed by rolling, forging, extrusion, and/or other suitable processes.

The process then welds the blanks to form the part (operation 406). In these examples, operation 406 is performed using friction stir welding. Of course, other types of welding techniques may be used, depending on the particular implementation.

The part is then heated to increase strength and/or reduce residual stress (operation 408), with the process terminating thereafter. In operation 408, the heating may be performed using thermal aging.

The aluminum alloy using zirconium as the enhancing system in the different advantageous embodiments provides around a 20 percent improvement in strength after friction stir welding as compared to published results for an aluminum alloy processed in a different manner from the process in FIG. 4.

Thus, the different advantageous embodiments provide a method and apparatus for an aluminum alloy. In the different advantageous embodiments, the aluminum alloy may be an aluminum magnesium alloy. For example, the aluminum alloy may comprise aluminum, magnesium from around 0.5 percent to about 10.0 percent by weight based on the aluminum alloy, scandium from about 0.05 percent to about 10.0 percent by weight based on the aluminum alloy, and an enhancing system from about 0.05 percent to about 1.5 percent by weight based on the aluminum alloy.

By processing this alloy in the manner described in one or more of the different advantageous embodiments, increased strength in the metal alloy may be achieved as compared to currently available metal alloys. Further, the different advantageous embodiments provide a capability to manufacture an aircraft part by joining blanks or sections of alloy rather than machining a larger block of aluminum alloy to form the part.

In this manner, one or more of the advantageous embodiments may provide decreased costs in manufacturing aircraft parts. These decreased costs may be accompanied by parts that may have the desired strength and other mechanical properties.

The description of the different advantageous embodiments has been presented for purposes of illustration and description, and it is not intended to be exhaustive or limited to the embodiments in the form disclosed. Many modifications and variations will be apparent to those of ordinary skill in the art.

Although the different advantageous embodiments have been described with respect to aircraft, other advantageous embodiments may be applied to other types of objects. For example, without limitation, other advantageous embodiments may be applied to a mobile platform, a stationary platform, a land-based structure, an aquatic-based structure, a space-based structure, and/or some other suitable object. More specifically, the different advantageous embodiments may be applied to, for example, without limitation, a submarine, a bus, a personnel carrier, a tank, a train, an automobile, a spacecraft, a space station, a satellite, a surface ship, a power plant, a dam, a manufacturing facility, a building, and/or some other suitable object.

Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method for processing an aluminum alloy, the method comprising:

forming the aluminum alloy in a form of a molten alloy, the aluminum alloy comprising: aluminum; magnesium from about 0.5 percent to about 10.0 percent by weight based on the aluminum alloy; scandium from about 0.05 percent to about 10.0 percent by weight based on the aluminum alloy; and an enhancing system from about 0.05 percent to about 1.5 percent by weight based on the aluminum alloy, wherein the enhancing system is selected from the group consisting of: titanium, vanadium, chromium, manganese, iron, cobalt, nickel, yttrium, zirconium, niobium, molybdenum, technetium, ruthenium, rhodium, palladium, silver, cadmium, hafnium, tantalum, tungsten, rhenium, osmium, iridium, platinum, gold, silver, lanthanum, cerium, praseodymium, neodymium, promethium, samarium, europium, gadolinium, terbium, dysprosium, holmium, erbium, thulium, ytterbium, lutetium, beryllium, calcium, strontium, barium, boron, germanium, indium, tin, lead, bismuth, and thorium;

casting the molten alloy into a plurality of sections using a continuous casting process, wherein casting prevents formation of scandium-rich phases in the molten alloy;

forming a plurality of blanks from the plurality of sections;

welding the plurality of blanks into a structure; and thereafter heating the structure in a manner that increases a strength of the plurality of blanks welded into the structure.

2. The method of claim 1, wherein the welding step comprises:

performing friction stir welding on the plurality of blanks to weld the plurality of blanks into the structure.

3. The method of claim 1, wherein the heating step comprises:

thermally aging the structure.

4. The method of claim 1, wherein the heating step comprises:

heating the structure from around 250 degrees Celsius to around 350 degrees Celsius for a period of time from around one hour to around twenty hours.

5. The method of claim 1 further comprising:

welding the plurality of blanks into a structure using friction stir welding; and heating the structure from around 250 degrees Celsius to around 350 degrees Celsius for a period of time from around one hour to around twenty hours, wherein a strength of the plurality of blanks welded into the structure increases.

6. The method of claim 1, wherein one portion of the plurality of blanks has a number of different sizes from another portion of the plurality of blanks.

7. The method of claim 1, wherein one portion of the plurality of blanks has a number of different shapes from another portion of the plurality of blanks.

8. The method of claim 1, wherein the structure is selected from the group consisting of a skin panel, a spar, a rib, a bulkhead, a keel, a longeron, a stringer, a gusset, a floor beam, a hinge, a stiffener, a flap track, a pin, a doubler, a splice plate, a trunnion, a slat track, a frame, and a fairing.

9. The method of claim 1, wherein the structure is for an object selected from the group consisting of a mobile platform, a stationary platform, a land-based structure, an aquatic-based structure, a space-based structure, an aircraft, a surface ship, a tank, a personnel carrier, a train, a spacecraft, a space station, a satellite, a submarine, an automobile, a power plant, a bridge, a dam, a manufacturing facility, and a building.

10. The method of claim 1, the step of forming the aluminum alloy comprising the enhancing system, wherein the enhancing system further comprises:

at least one of: a period 4 transition element, a period 5 transition element, a period 6 transition element, a period 7 transition element, a lanthanide, a group 2 element, a group 13 metallic element, a group 14 metallic element, a group 15 metallic element, a group 13 semi-metallic element, a group 14 semi-metallic element, a group 15 semi-metallic element.

11. A method for processing an aluminum alloy, the method comprising:

forming a molten aluminum alloy comprising: aluminum; magnesium from about 0.5 percent to about 10.0 percent by weight based on the molten aluminum alloy; and scandium from about 0.05 percent to about 10.0 percent by weight based on the molten aluminum alloy;

continuously casting the molten aluminum alloy into a plurality of blanks, wherein continuously casting prevents formation of scandium-rich phases in the aluminum alloy;

forming a welded part by welding the plurality of blanks; and thereafter heating the welded part to increase a strength of the welded part.

12. The method of claim 11, wherein the heating comprises:

heating the welded part from around 100 degrees Celsius to around 400 degrees Celsius for a period of time from around a few minutes to around a few hundred hours.

13. The method of claim 11, wherein the heating comprises:

heating the welded part from around 250 degrees Celsius to around 350 degrees Celsius for a period of time from around one hour to around twenty hours.

14. The method of claim 11, wherein the welding is via friction stir welding to avoid melting of the plurality of blanks and to avoid grain growth of the plurality of blanks.

15. The method of claim 11, wherein continuously casting provides an increased metal solidification rate and allows the use of alloying element additions.

16. The method of claim 11, wherein the molten aluminum alloy includes an enhancing system from about 0.05 percent to about 1.5 percent by weight based on the molten aluminum alloy, the enhancing system selected from the group consisting of:

at least one of: a period 4 transition element, a period 5 transition element, a period 6 transition element, a period 7 transition element, a lanthanide, a group 2 element, a group 13 metallic element, a group 14 metallic element, a group 15 metallic element, a group 13 semi-metallic element, a group 14 semi-metallic element, a group 15 semi-metallic element.

17. The method of claim 11, wherein the molten aluminum alloy includes an enhancing system from about 0.05 percent to about 1.5 percent by weight based on the molten aluminum alloy, the enhancing system selected from the group consisting of:

at least one of titanium, vanadium, chromium, manganese, iron, cobalt, nickel, yttrium, zirconium, niobium, molybdenum, technetium, ruthenium, rhodium, palladium, silver, cadmium, hafnium, tantalum, tungsten, rhenium, osmium, iridium, platinum, gold, silver, lanthanum, cerium, praseodymium, neodymium, promethium, samarium, europium, gadolinium, terbium, dysprosium, holmium, erbium, thulium, ytterbium, lutetium, beryllium, calcium, strontium, barium, boron, germanium, indium, tin, lead, bismuth, and thorium from about 0.05 percent to about 1.5 percent by weight based on the molten aluminum alloy.

* * * * *